US007036536B1

(12) United States Patent
Knight et al.

(10) Patent No.: US 7,036,536 B1
(45) Date of Patent: May 2, 2006

(54) FUEL SPOUT WITH A COLLECTION CHANNEL

(75) Inventors: Paul A Knight, Spokane, WA (US); Walt D Takisaki, Spokane, WA (US)

(73) Assignee: KnuBox Technologies, Spokane, WA (US)

( * ) Notice: Subject to any disclaimer, the term of this patent is extended or adjusted under 35 U.S.C. 154(b) by 0 days.

(21) Appl. No.: 11/068,648

(22) Filed: Feb. 22, 2005

Related U.S. Application Data

(60) Provisional application No. 60/547,693, filed on Feb. 23, 2004.

(51) Int. Cl.
*B65B 1/04* (2006.01)

(52) U.S. Cl. ..... 141/86; 141/286; 141/311 A; 137/312; 222/571

(58) Field of Classification Search ..... 141/86, 141/115–118, 206–229, 286, 311 A; 137/312; 222/108, 568, 571
See application file for complete search history.

(56) References Cited

U.S. PATENT DOCUMENTS 5,139,182 A * 8/1992 Appla ..... 222/519
6,520,222 B1 * 2/2003 Carmack et al. ..... 141/311 A

* cited by examiner

*Primary Examiner*—Timothy L. Maust
(74) *Attorney, Agent, or Firm*—KnuBox Technologies; Paul A. Knight

(57) ABSTRACT

The present invention is directed to fuel dispensing nozzles and more particularity to a spout of a fuel dispensing nozzle that reduces the amount of harmful emissions created during a fueling cycle. The spout of the nozzle has an inside surface that is in direct contact with a flow of fuel. After the flow of fuel is stopped, the residual amount of fuel adhered to the inside spout surface is encouraged to collect and drip from at least one fuel collection channel. The at least one fuel channel results in less fuel dripping on the ground and less residual fuel, both of which harmfully evaporate into the air.

9 Claims, 3 Drawing Sheets

FUEL SPOUT WITH A COLLECTION CHANNEL

CROSS REFERENCE TO RELATE APPLICATION

This application claims priority from U.S. provisional patent application No. 60/547,693 filed on Feb. 23, 2004.

STATEMENT REGARDING FEDERALLY SPONSORED R&D

Not related to this application.

TECHNICAL FIELD

This invention relates to fuel nozzles and more particularly to a fuel dispensing spout that reduces the amount of pollution caused after the flow of fuel is stopped.

BACKGROUND OF THE INVENTION

Fuel dispensing nozzles are widely used and understood in the field. Early fuel nozzles are mainly comprised of a manual actuated valve and a metallic spout for directing fuel into a desired container. Many improvements have been made to fuel nozzles, including U.S. Pat. No. 4,453,578, which provide the means of automatically stopping fuel flow when the fuel reaches a desired level.

In addition, many design improvements have been made regarding nozzle spouts. U.S. Pat. No. 5,765,609 describes a method for manufacturing an aluminum spout that removably attaches to a nozzle body. Removable spouts enable them be replaced in shorter intervals than the more expensive nozzle body. Replacing a spout may be desirable when a nozzle is left in a motor vehicle after drive-away, upon considerable wear, or as improved spouts become available.

Recently, significant attention has been directed to the adverse environmental effects caused by fuel dispensing nozzles. One such effect is caused by fuel vapors displaced from a container as heavier liquid fuel is dispensed into the container. The displaced vapors contain volatile organics that chemically react with nitrogen oxides to form ground level ozone, often called "smog". Ground level ozone can potentially cause irritation to the nose, throat, lungs and bring on asthma attacks. In addition, gasoline vapors are suspected to contain other harmful toxic chemicals, such as benzene.

In an effort to reduce the amount of harmful vapors that reach the atmosphere, a vapor recovery nozzle has been developed; one version of the spout is best described by U.S. Pat. No. 4,351,375. This version of a vapor recovery nozzle is comprised of a coaxial tube that both dispense fuel through a main tube and vacuum vapors through a secondary channel. A large percentage of the captured vapors are treated and safely released in the atmosphere. Vapor recovery systems are required by the laws of many states, especially at high volume stations or stations located in densely populated areas.

Although vapor recovery has significantly reduced the amount of volatile organics that reach the atmosphere during fueling, there are several other sources of fuel vapors that contribute to the problem of "smog". One such source is fuel dripped from a nozzle spout after fueling. Typically, when a nozzle is deactivated there is a delay before the user removes the nozzle spout from the container to be filled. If the delay is sufficient, drops from the spout will fall into the container.

If the delay is insufficient, drops fall onto the ground or the local filling equipment. Spilt fuel evaporates into the atmosphere and contaminates the ground. Even waiting a significant amount of time before removing the nozzle will not ensure that dripping will not occur. Some users try to supplement waiting by tapping the nozzle spout on the fill tube of the container prior to removing it.

In an effort to further reduce sources of "smog" many new nozzle requirements and laws have been implemented. One such requirement is for fuel nozzles to be dripless. The goal is to have zero drops fall from a nozzle spout after the flow has stopped and a reasonable amount of time has elapsed. Many new nozzle designs are directed towards the goal of dripless, such as U.S. Pat. No. 6,520,222, U.S. Pat. No. 5,603,364, U.S. Pat. No. 4,213,488, U.S. Pat. No. 5,645,116, and U.S. Pat. No. 5,620,032. Although the aforementioned patents may potentially serve in the direction of their intended purposes, most are unlikely to reliably provide true dripless performance. Many proposed dripless nozzles continue to drip fuel long after the period of time it takes for a user to remove a spout from a tank.

In these respects, the fuel spout with a collection channel, according to the present invention, substantially departs from conventional concepts of the prior art, and in doing so provides an apparatus primarily designed for the purpose of reducing the amount of pollution created during a fueling cycle.

SUMMARY OF THE INVENTION

The present invention is directed to fuel dispensing nozzles and more particularity to a spout of a fuel dispensing nozzle that reduces the amount of harmful emissions created during a fueling cycle. The spout of the nozzle has an inside surface that is in direct contact with a flow of fuel. After the flow of fuel is stopped, the residual amount of fuel adhered to the inside spout surface is encouraged to collect from an least one fuel collection channel. The collected fuel has fluid properties that are more optimal for drip management and pollution reduction. The at least one fuel channel results in less fuel dripping on the ground and less residual fuel, both of which harmfully evaporate into the air. A single channel may be used but depending upon particular applications and uses, more than one may be preferable. The one or more collection channels may be any common shape and may be used with vapor recovery and dripless style nozzles.

These and other features, aspects, and advantages of the present invention will become better understood with regard to the following description, appended claims, and accompanying drawings.

BRIEF DESCRIPTION OF THE DRAWINGS

Preferred embodiments of the invention are described below with the reference to the following accompanying drawings.

DETAILED DESCRIPTION OF THE PREFERRED EMBODIMENTS

Many of the fastening, connection, manufacturing and other means and components utilized in this invention are widely known and used in the field of the invention are described, and their exact nature or type is not necessary for a person of ordinary skill in the art or science to understand the invention; therefore they will not be discussed in detail.

Figure 1:
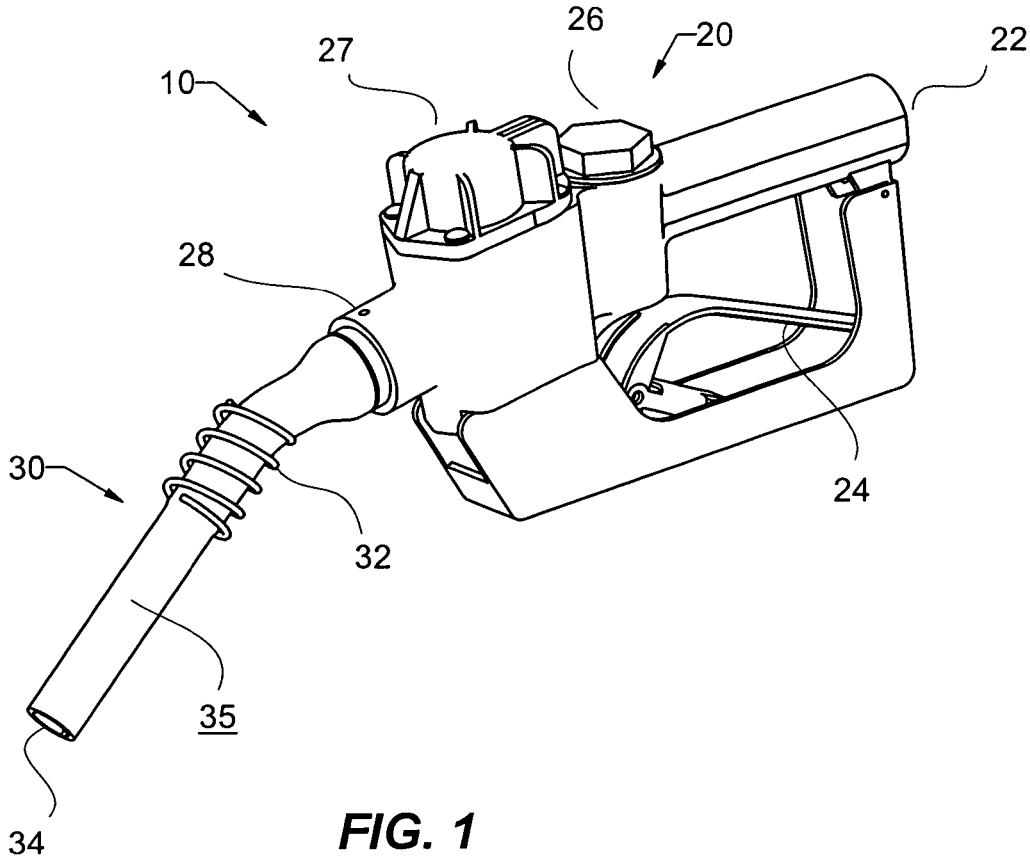
FIG. 1 is a perspective view of fuel dispensing nozzle and according to the present invention.
Figure 2:
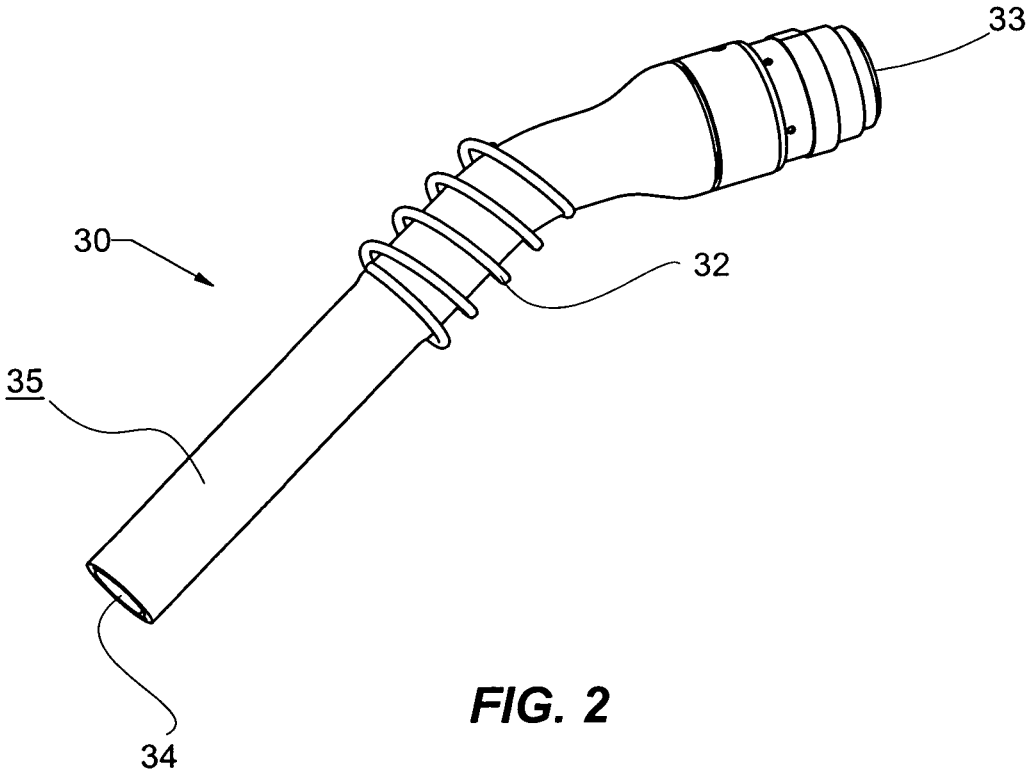
FIG. 2 is a perspective view of the fuel dispensing spout of FIG. 1.
Figure 7:
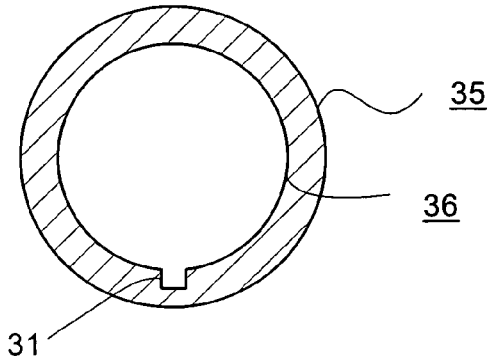
FIG. 7 is an end view of an alternative rectangular fuel collection channel.
Figure 8:
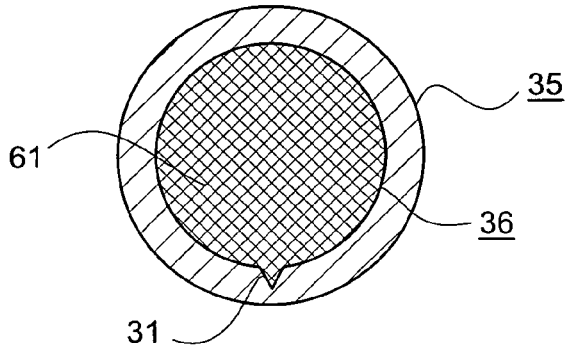
FIG. 8 is an end view of a fuel collection channel working in concert with a dripless spout nozzle plunger.
Figure 9:
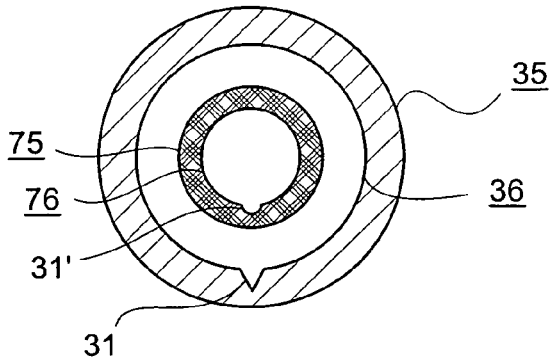
FIG. 9 is an alternative vapor recovery spout embodiment and according to the present invention.

FIG. 1 shows a fuel dispensing nozzle assembly 10, comprised of a prior art nozzle assembly 20, and a spout assembly 30 according to the present invention. Prior art nozzle assembly 20 is used for dispensing fuel into a container to be filled (not shown) according to well known fuel dispensing apparatuses and practices. Fuel nozzle assembly 20 may be, but is not limited to, a standard nozzle as shown in FIGS. 1–8, or a vapor recovery nozzle as shown in FIG. 9. Generally, fuel is supplied to nozzle assembly 20 by connecting a hose assembly (not shown) to an inlet 22. The pressurized fuel supply travels to a valve assembly 26, which in combination with a lever 24 regulates its flow. The fuel that flows through valve 24 may travel through a shutoff valve 27. Fuel nozzle 20 shown, is a version that stops the flow of fuel when it reaches a full condition within the container to be filled. The operation of such a nozzle is commonly understood and described by many U.S. Patents including U.S. Pat. No. 4,351,375, herein incorporated by this reference, and because they are commonly understood by one skilled in the art they will not be discussed in further detail. It should be appreciated, however, that the present invention is not limited to any particular version of nozzle assembly.

Connected to nozzle assembly 20 by a screw hole 28 is spout assembly 30. Spout 30 has a fuel inlet end 33 that receives fuel from nozzle assembly 20. End 33 may include o-rings (not shown) for creating a fuel tight seal. End 33 may also include passage holes for communicating with shutoff valve 27, and a check valve. Regardless of the specific configuration, spout 30 is used for directing the flow of fuel into the container to be filled while dispensing the fuel out a dispensing end 34. Spout 30 has an inside surface 36 in direct contact with the fuel and an outside surface 35. A coil 32 located on outside surface 35 keeps spout 30 from being over inserted into the container to be filled. Coil 32 is optional.

Figure 3:
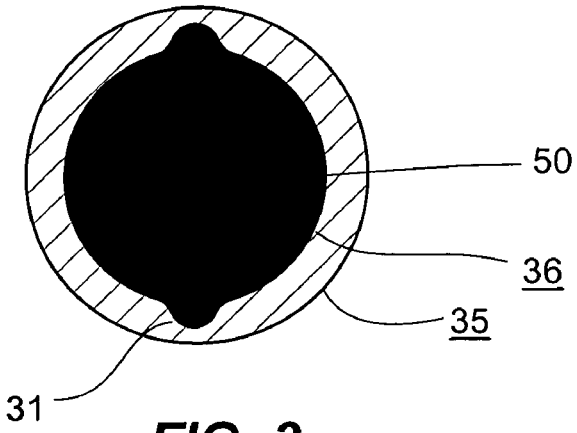
FIG. 3 is an end view of the fuel dispensing spout of FIG. 2 while fuel is flowing through the nozzle.
Figure 4:
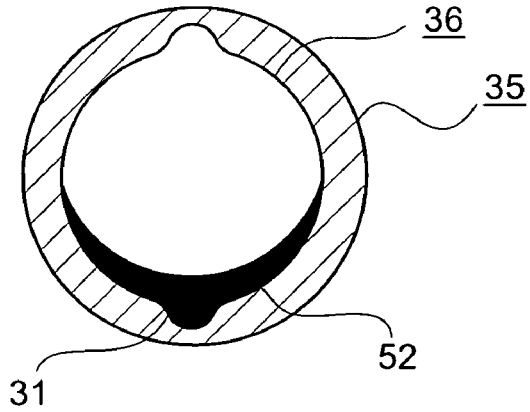
FIG. 4 is an end view of the fuel dispensing spout of FIG. 3 soon after the flow of fuel through the nozzle is stopped.
Figure 5:
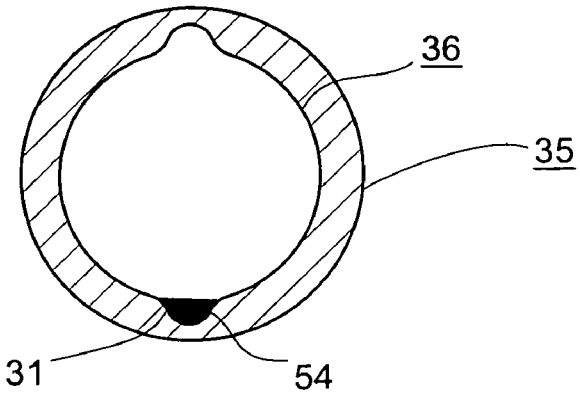
FIG. 5 is a an end view of the fuel dispensing spout of FIG. 4 a period of time after FIG. 4.

Unlike the prior art and according to the present invention, inside surface 36 includes a one or more fuel collection channels 31. Fuel collection channel 31 is used to collect fuel on inside surface 36. This collection process is shown by FIGS. 3, 4, and 5. In FIG. 3, a flow of fuel 50 is shown completely filling the inside of spout 30 and completely covering inside surface 36. FIG. 3 describes a situation when valve 26 is open.

FIG. 4 shows a condition soon after valve 26 going from its open to closed position. A large percentage of fuel 50 has flown into the container to be filled, but due to attraction between the fuel and the material of spout 30, the remaining percentage of fuel 50 creates a thin-film 52. The flow of thin-film 52 is complicated and may create a random dripping of fuel into the container to be filled. When the mass of a fuel drop is sufficient to overcome the attractive forces acting upon it, it drips from dispensing end 34. The conditions of FIG. 4 are likely to result in one or more drops. It is highly desirable to have the drops fall into the container to be filled rather than have it left on the spout after fueling. Residual fuel turns to vapor and creates negative environmental effects. Because many spouts are constructed from aluminum, with a surface energy significantly higher than the fuel, prior art nozzles encourage the remaining fuel to wick up the sides of inside surface 36 further creating attractive forces and further reducing dripping. Fuel collection channel 31 according to the present invention encourages thin-film 52 to collect to a central location. At the location of collection channel 31, the mass versus adhesive relationship is more favorable to dripping than the prior art. Collection channel 31 preferably starts at dispensing end 34 and travels inward towards end 33. Optimal dimensions of channel 31 may be a function of fuel properties and spout geometry. A potential drop 54 is shown in FIG. 5. This encouragement of dripping causes more drops to fall into the container to be filled prior to the user removing nozzle 10 from the container. This present invention may translate into less fuel drops landing on the ground and less residual fuel left on the nozzle after fueling; both resulting in less harmful vapors being emitted into the atmosphere.

As shown in FIG. 5, and after the condition shown in FIG. 4, fuel is encouraged to collect within collection channel 31. This state allows for more drips to occur, but also provides a favorable condition for the use with a one or more dripless features 61, as shown in FIG. 8. Dripless features 61, may be a plunger such as described U.S. Pat. No. 6,520,220, herein incorporated by this reference. The task of achieving true "dripless" performance is difficult and often results in occasional drops. Focusing residual fuel to a particular location may allow dripless features to achieve more dripless performance. The thin-film fuel flow becomes more predictable.

As shown by FIGS. 3, 4, and 5, collection channel 31 is preferably located in the two nozzle orientations typically used during fueling (nozzle up and down) and hence it is preferable to have more than one collection channel 31. Although two of collection channel 31 is shown, there is no limit to the quantity that may be employed. It may also be desirable to have a plurality of intersecting or non-parallel channels (branches) that direct the fuel in desired locations. It may also be desirable to coat inside surface 36 with a low surface energy coating such as described by commonly assigned U.S. Pat. No. 6,854,491 entitled "Low Surface Energy Fuel Dispensing Spout" which is herein incorporated by this reference. The combination of a low fuel surface energy surface and collection channel 31 may provide even further environmental savings. It may also be desirable to put low surface energy bands in combination with bare aluminum (higher energy) bands within surface 36 and thus take advantage of differences in surface energy to control film thickness in desired locations.

In addition, the performance of collection channel 31 may also be improved through the use of a curved endface, between surfaces 35 and 36, such as described by pending U.S. patent application Ser. No. 10/733,920, entitled "Fuel Dispensing Spout with a Continuous Endface", filed on Dec. 11, 2003. The combination of inventions may result in even further environmental improvements.

Figure 6:
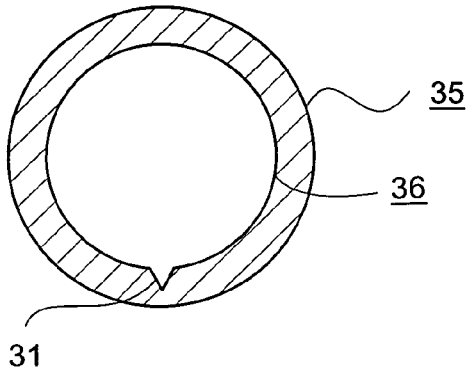
FIG. 6 is an end view of an alternative triangle fuel collection channel.

Other embodiments of the present invention are possible. FIG. 6 shows a triangular shape. FIG. 7 shows a rectangular shape. The present invention is not limited to any one particular shape, and may be made from complex shapes. The goal of any shape is to balance manufacturing ease with favorable drop conditions. By collecting fuel to a localized area, drops are encouraged to fall into the container to be filled.

Yet another embodiment of the present invention is shown in FIG. 9. A coaxial vapor recovery version is shown. A vapor recovery nozzle is described by U.S. Pat. No. 5,255,723 and is hereby incorporated by this reference. In this embodiment, a inner fuel supply tube is shown with an inside surface 76 and an exterior surface 75. A vapor recovery fuel channel 31' is shown and used according to the already disclosed methods of the present invention. Because vapor travels between surface 36 and 75 it may be desirable to continue the use of channel 31 in this embodiment, in combination with channel 31'.

While the fuel spout with a fuel collection channel herein described constitute preferred embodiments of the invention, it is to be understood that the invention is not limited to these precise form of assemblies, and that changes may be made therein with out departing from the scope and spirit of the invention.

We claim:

1. A fuel dispensing apparatus comprising:

a generally tubular spout having a first end receiving a supply of fuel from a fuel dispensing nozzle having an automatic shut-off valve, and a second end discharging said supply of fuel;

said spout having an inside surface connecting said first end to said second end;

wherein said inside surface has at least one channel having a length extending from said second end and substantially in the direction of said first end; and, wherein said supply of fuel is in contact with said at least one channel.

2. The fuel dispensing apparatus of claim 1, wherein said spout is configured as a vapor recovery spout.

3. The fuel dispensing apparatus of claim 1, wherein said spout includes a feature for reducing drips.

4. A fuel dispensing apparatus comprising:

a tubular spout having a first end receiving a supply of fuel from a fuel dispensing nozzle having an automatic shut-off valve, and a second end discharging said supply of fuel;

said spout having an inside surface connecting said first end to said second end;

wherein said inside surface has at least one collection grooves starting at said second end and having a length extending substantially in the direction of said first end; and, wherein said supply of fuel is in contact with said at least one collection groove.

5. The fuel dispensing apparatus of claim 4, wherein said spout is configured as a vapor recovery spout.

6. The fuel dispensing apparatus of claim 4, wherein said spout includes a feature for reducing drips.

7. A fuel dispensing apparatus comprising:

a tubular spout having a receiving end, a discharge end, and an inside surface, said inside surface capable of directing a flow of fuel from a fuel dispensing nozzle having an automatic shut-off valve; and, wherein said inside surface includes an at least one fluid groove capable of being in contact with and directing a residual amount of said flow of fuel within said spout out said discharge end.

8. The fuel dispensing apparatus of claim 7, wherein said spout is configured as a vapor recovery spout.

9. The fuel dispensing apparatus of claim 7, wherein said spout includes a feature for reducing drips.

* * * * *